US008098172B2

(12) United States Patent
Graham

(10) Patent No.: US 8,098,172 B2
(45) Date of Patent: Jan. 17, 2012

(54) ADAPTABLE TRAFFIC CONTROL SIGN

(76) Inventor: Matthew M. Graham, Chandler, AZ (US)

( * ) Notice: Subject to any disclaimer, the term of this patent is extended or adjusted under 35 U.S.C. 154(b) by 333 days.

(21) Appl. No.: 12/286,030

(22) Filed: Sep. 26, 2008

(65) Prior Publication Data

US 2009/0079588 A1 Mar. 26, 2009

Related U.S. Application Data

(60) Provisional application No. 60/975,451, filed on Sep. 26, 2007.

(51) Int. Cl.
*G08G 1/095* (2006.01)

(52) U.S. Cl. ..... 340/908; 40/586; 340/321

(58) Field of Classification Search ..... 340/907, 340/908, 815.45, 321; 40/586, 606
See application file for complete search history.

(56) References Cited

U.S. PATENT DOCUMENTS 6,204,777 B1 * 3/2001 Lyons ..... 340/908
2004/0104810 A1 * 6/2004 Scott ..... 340/321
2005/0062616 A1 * 3/2005 Vernon-Dier et al. ..... 340/908
2006/0012487 A1 * 1/2006 Gibson et al. ..... 340/815.45
2006/0061487 A1 * 3/2006 Heap ..... 340/908
2009/0079588 A1 * 3/2009 Graham ..... 340/908

* cited by examiner

*Primary Examiner* — Brent Swarthout

(74) *Attorney, Agent, or Firm* — Dean A. Craine

(57) ABSTRACT

A portable traffic control sign that includes a lightweight sign head selectively attachable to a lightweight pole. The sign head includes a thin interior frame sandwiched between two opposite facing, traffic sign panels. The interior frame includes an octagonal outer support structure and an inner support structure. Attached to the opposite surfaces of the outer and inner support structures are two arrays of LED bulbs. The two sign panels each include a thin transparent window. When placed on opposite sides of the interior sign frame, light from the first and second array of LED bulbs is able to be transmitted through the two windows exteriorly. In the preferred embodiment, each panel is made of DOT approved retro-reflective material. The two arrays are connected to a main control unit mounted inside the lightweight pole which also contains the battery pack and optional flasher switches.

11 Claims, 8 Drawing Sheets

ADAPTABLE TRAFFIC CONTROL SIGN

This is a utility patent application which claims benefit of U.S. Provisional Application No. 60/975,451, filed on Sep. 26, 2007.

BACKGROUND OF THE INVENTION

1. Field of the Invention

The present invention relates to illuminated displays, and more particularly to handheld traffic control signs that can be used as an illuminated or non-illuminated sign 2. Description of the Related Art Roadway construction workers, utility workers and traffic control personnel often use hand-held traffic signs to control the flow of traffic. The size and shapes of the signs are standardized and controlled by federal and state regulations. Ideally, hand-held traffic signs should be lightweight and constructed in a manner and made of materials that are durable and able to withstand the forces and climate conditions exerted on them during normal use.

It is well known that illuminated traffic signs are more effective in drawing attention than non-illuminated traffic signs. Unfortunately, portable illuminated traffic signs contain components that make them heavy and susceptible to breakage. In addition, the light bulbs commonly used on illuminated traffic signs are often exposed and easily broken.

Portable, handheld traffic signs are usually planar structures made of retro-reflective material designed to reflect light back to its source. At night, the headlights of approaching motor vehicles illuminate the retro-reflective material that reflects the light from the headlights back to the approaching drivers. One advantage of such signs is that use lights from the headlights and are not dependent on batteries or light bulbs. One drawback with such traffic signs, however, is that if the motor vehicle's headlights are turned off, mis-aimed, or if the sign is not held at the proper angle, the driver of the approaching motor vehicle, the drivers in adjacent motor vehicles, and nearby pedestrians not located within the angle of reflection and do not see the reflected light.

It is well known that motor vehicle collisions at roadway construction sites are common. Rear end collisions, which are the most common type of accidents at roadway construction sites, are caused by drivers unaware of an upcoming slow down. The problem is especially troublesome when the slow down occurs upstream from the construction site well beyond the illumination distance of a standard illuminated or a retro-reflective sign.

What is needed is a portable, illuminated and retro-reflectively handheld traffic sign that provides greater visibility during dark and light conditions, and that use concealed lights that are protected against impact damage.

SUMMARY OF THE INVENTION

These and other objects are met by an adaptable, handheld traffic control sign that includes a lightweight sign head with two opposite traffic sign panels attached to the distal end of a lightweight pole. The sign head includes a lightweight interior frame located between a first traffic sign panel and a second traffic sign panel. The interior frame includes a rigid, lightweight, octagonal-shaped, outer support structure. In the preferred embodiment, the outer support structure is T-shaped in cross-section and includes a continuous wide outer flange member and an inward extending flange member. The inward flange member is centrally and perpendicularly aligned with the outer flange member.

Formed inside and in the same plane as the outer support structure is a diamond- shaped, rigid inner support structure. The corners of the inner support structure are attached to the inside flange member on the outer frame structure. Attached to the opposite sides of the inward flange member of the outer support structure and the inner support structure are two arrays of LED bulbs.

The first and second traffic sign panels include traffic control related indicia, such as the words 'STOP' and 'SLOW', printed thereon, respectively, so that the two sign panels may be visible to drivers moving in opposite directions when the pole is held upright. When assembled, the two traffic sign panels are placed on opposite sides of the interior frame. Formed near the outer edge of the first traffic sign panel is a thin, octagonal-shaped transparent window that enables light from the first array of LED bulbs attached to the interior flange of the outer support structure to be seen when illuminated. The second traffic sign panel includes a thin, diamond-shaped transparent window that enables light from the second array of LED bulbs attached to the inner support structure to be seen through the second traffic sign panel when illuminated. In the preferred embodiment, the visible areas surrounding two windows on the first and second traffic sign panels are made of retro-reflective material to increase visibility at night.

In the preferred embodiment, a battery pack is attached to the proximal end of the pole. Also, mounted inside the pole is a control unit that connects to the two arrays of LED bulbs, a main switch connected to the control unit that selectively controls activation and deactivation of the two arrays. Also, mounted inside the control unit is an optional flasher and flasher switch that enables the user to energize the two arrays of LED bulbs between constant ON or continuous flasher ON modes.

DESCRIPTION OF THE PREFERRED EMBODIMENT(S)

Referring to the accompanying FIGS. 1-10 there is shown a portable traffic control sign 10 that includes a lightweight sign head 12 with two traffic sign panels 31, 50 located on its opposite sides that selectively attaches to the distal end of a lightweight pole 80. The sign head 12 includes a lightweight interior framel4 located between the first and a second sign panels 31, 50, respectively.

Figure 1:
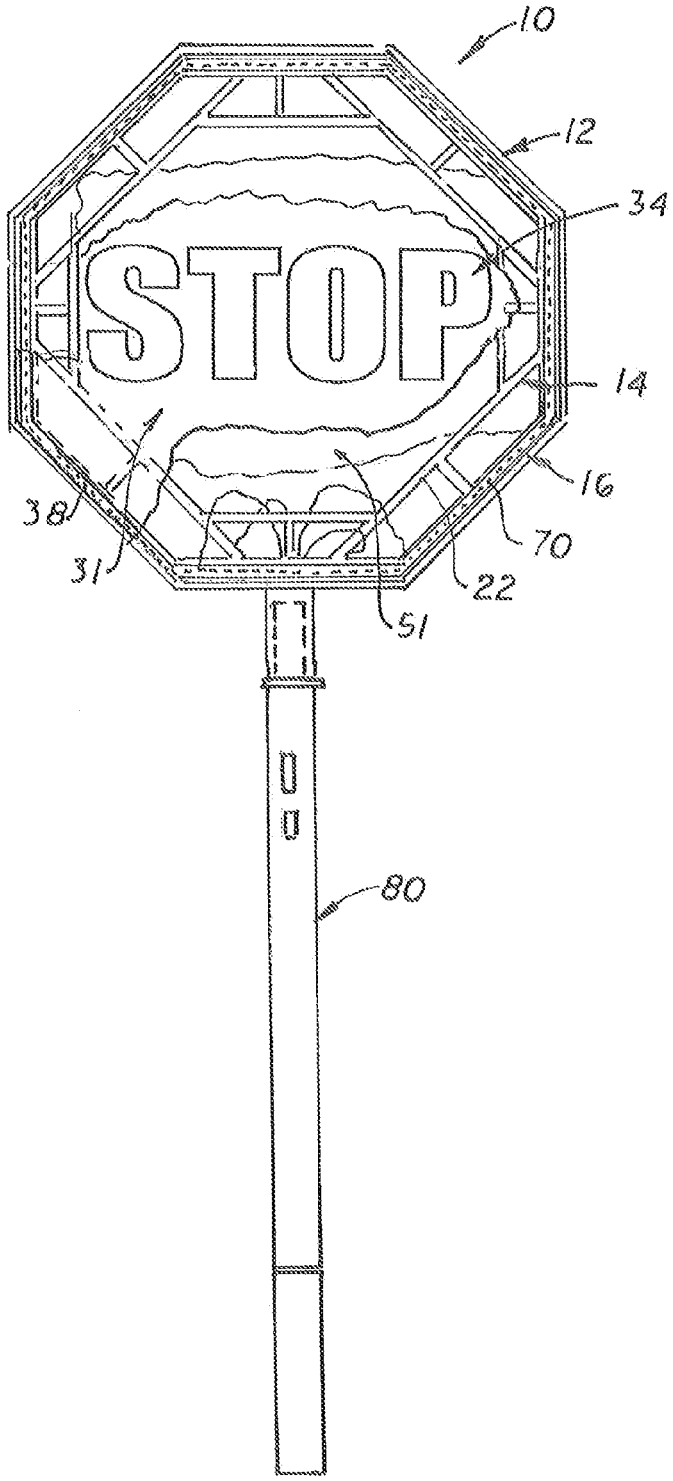
FIG. 1 is a front elevational view of the illuminated traffic control sign disclosed herein.
Figure 2:
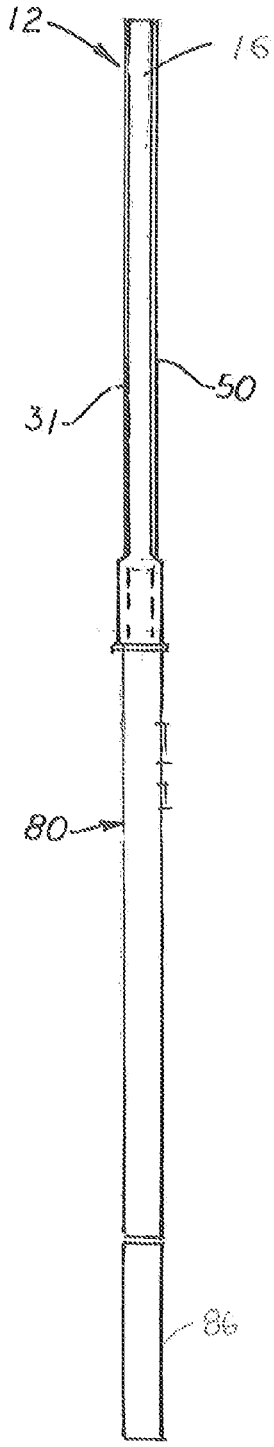
FIG. 2 is a side elevational view of the traffic control sign shown in FIG. 1.
Figure 3:
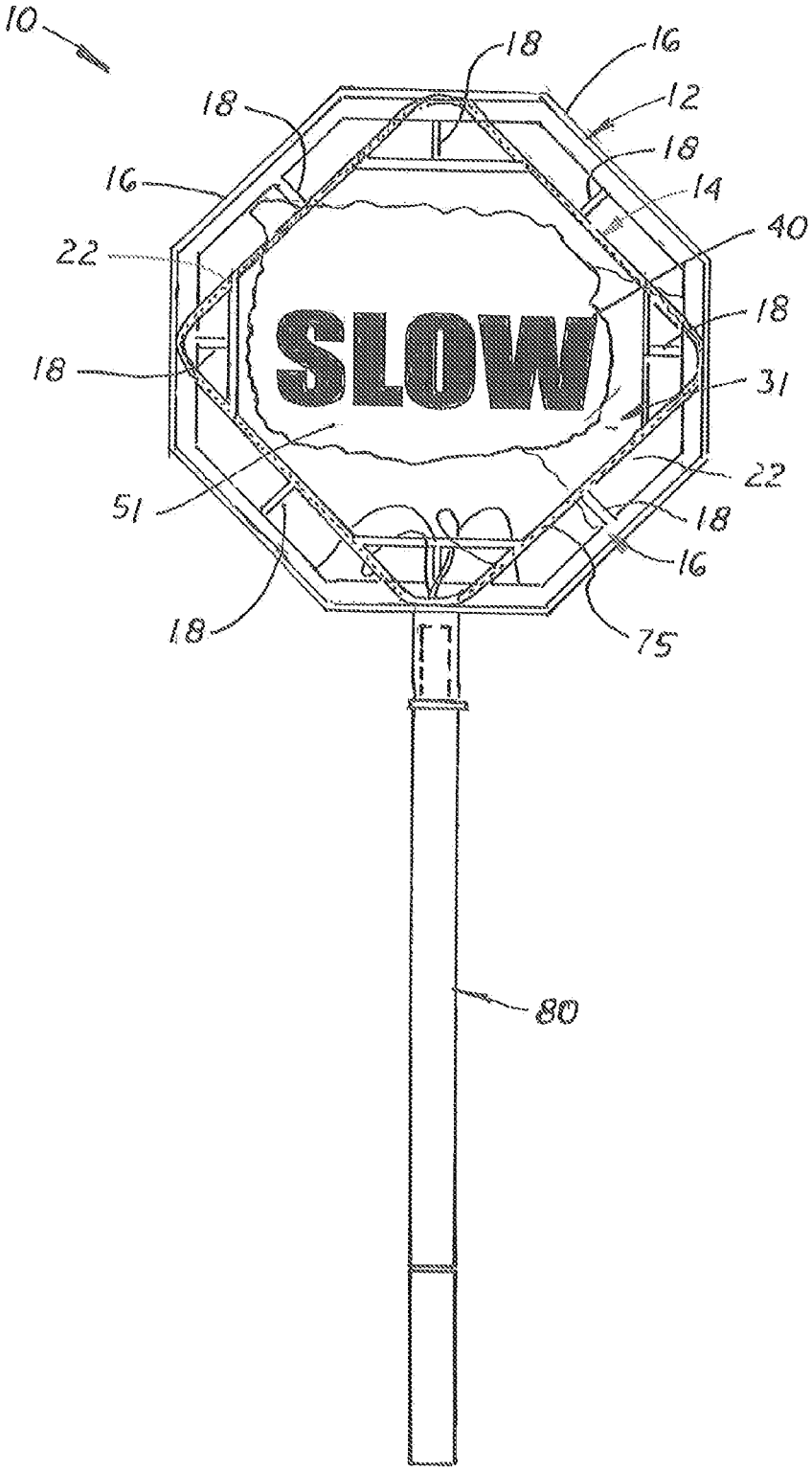
FIG. 3 is a rear elevational view of the illuminated traffic control sign shown in FIG. 1.
Figure 4:
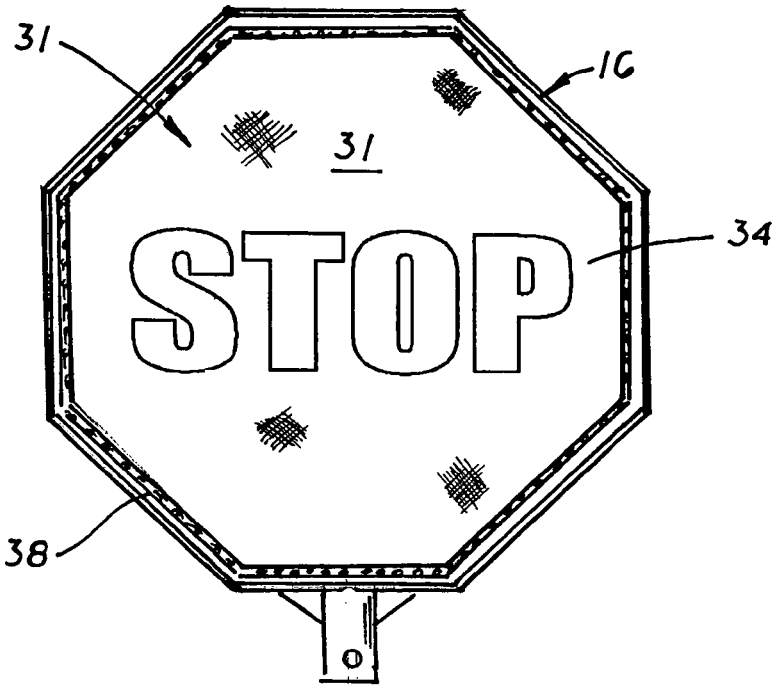
FIG. 4 is a front elevational view of the sign head showing the first traffic sign panel.

As shown in FIGS. 1-5, the first and second sign panels 31, 50 include traffic control related indicia, such as STOP 34 and SLOW 40, respectively, printed centrally thereon. During use, the traffic control sign operator may easily rotate and present the two sign panels 31, 50 to drivers approaching the sign 10 in opposite directions. When assembled, the interior frame 14 provides a semi-rigid support for each sign panel 31, 50. Because STOP signs are typically octagonal, the first sign panel 31, as shown in FIG. 4, is a flat planar structure with an octagonal-shaped outer edge designed to fit snuggly inside the outer support structure 16. Formed near the outer edge of the STOP sign panel 31 is a thin, octagonal-shaped narrow window 38 that enables light from the first array of LED bulbs 70 attached to the interior frame 14 to be seen when illuminated.

Figure 5:
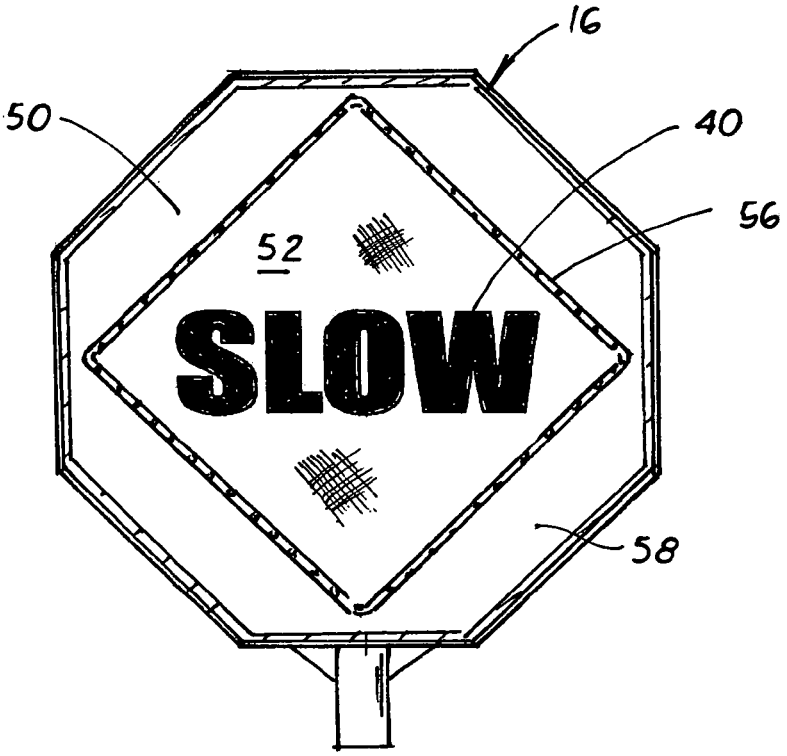
FIG. 5 is a rear elevational view of the sign head showing the section traffic sign panel.

The second sign panel 50 is also octagonal-shaped and also designed to fit snuggly inside the outer support structure 16. As shown in FIG. 5, the second sign panel 50 includes a central, diamond-shaped area 52 with the word. SLOW 40 printed therein. Surrounding the diamond-shaped area 52 is a thin, four sided diamond-shaped narrow window 56 that enables light from the second array of LED bulbs 75 attached to the interior frame 14 to be seen when illuminated. The outer area 58 on the SLOW sign panel 50 surrounding the word SLOW 40 is diamond-shaped and typically black or yellow.

Figure 6:
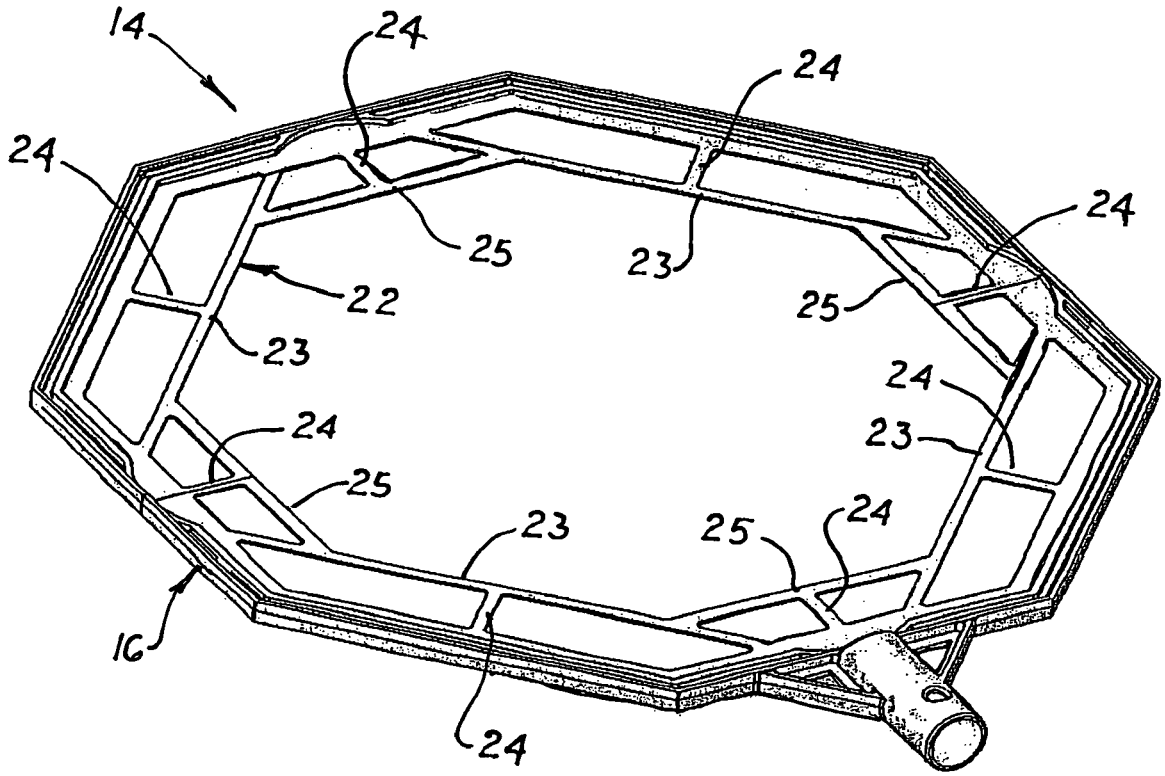
FIG. 6 is a perspective view of the interior frame used on the sign head.
Figure 7:
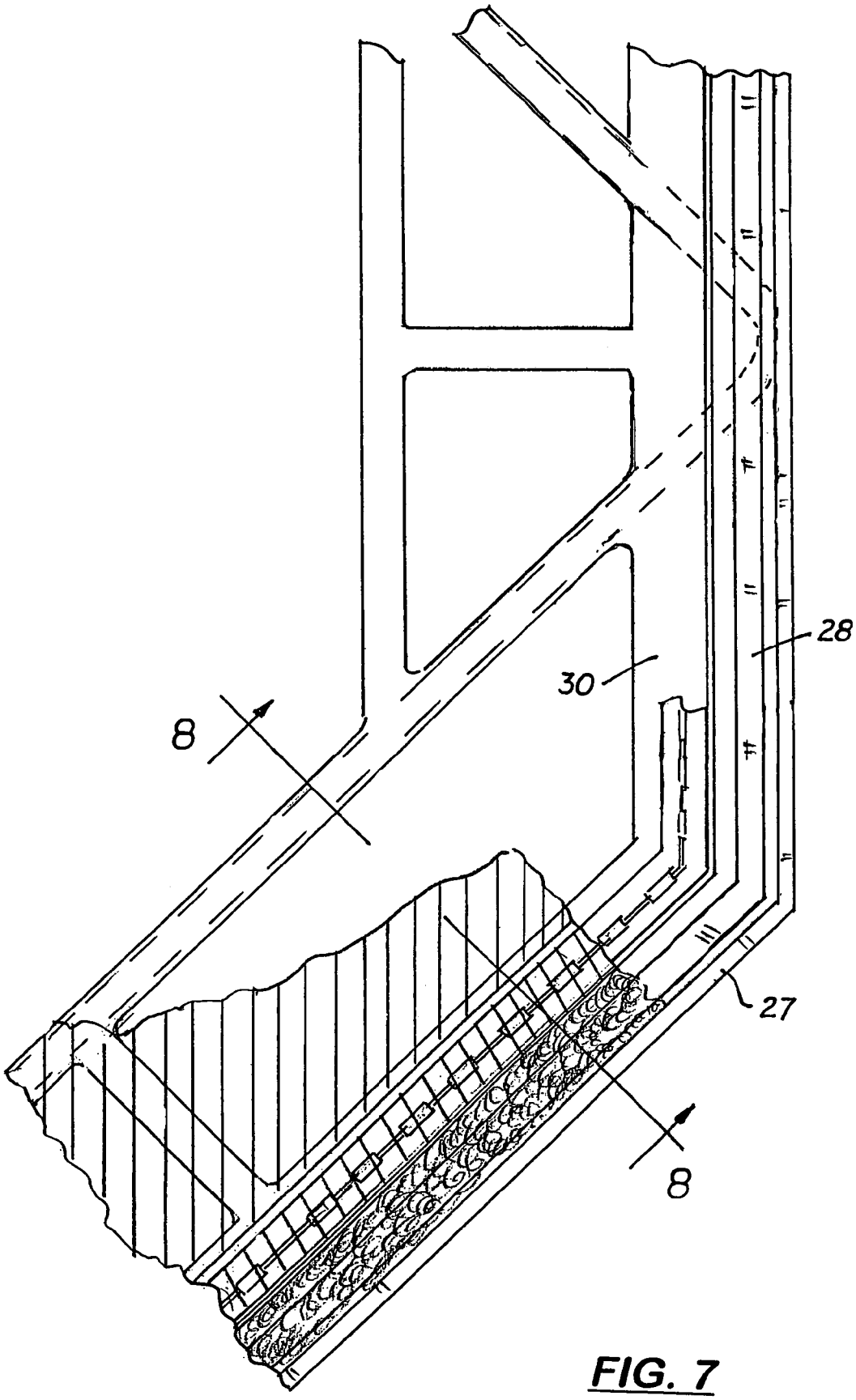
FIG. 7 is a partial, top plan view showing the edge of the traffic control sign.
Figure 8:
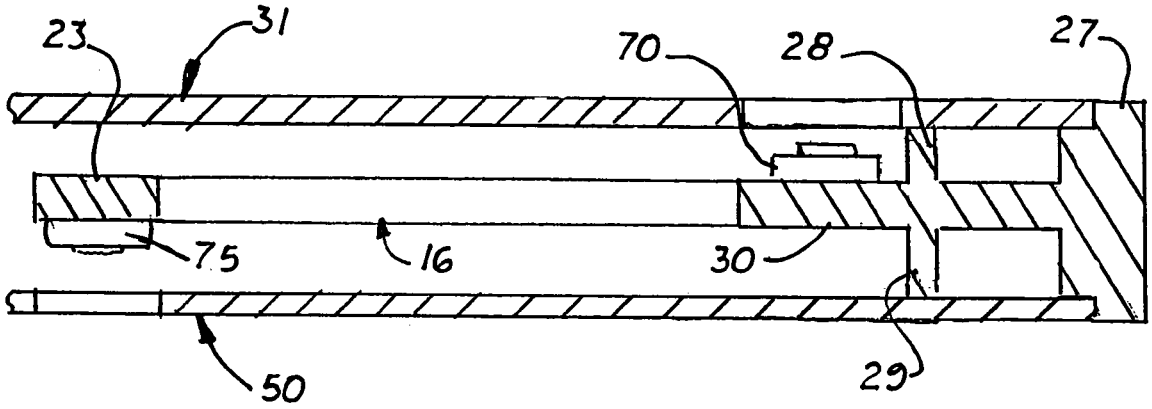
FIG. 8 is a sectional, side elevational view of the sign head taken along line 8-8 in FIG. 7.

The interior frame 14, shown more clearly in FIGS. 1, 3, 6 and 7 includes a rigid, lightweight, octagonal-shaped, outer support structure 16. Integrally formed or attached to the outer support structure 16 is a four-sided, diamond-shaped, rigid inner support structure 22. As shown in FIG. 6, the interior support structure 22 includes four support struts 23. The ends of the four struts 23 are attached to the inside edge of the outer support structure 16. Disposed between adjacent support struts 23 are short cross struts 25. Optional support braces 24 are used between the support struts 23, the short cross struts 25, and the adjacent outer support structure 16. As shown in FIG. 8, the outer portion of the outer support structure 16 is T-shaped in cross-section and includes an outside flange member 27 and a perpendicularly aligned, inward extended support flange member 30. Perpendicularly aligned and formed on the opposite inside surfaces of the flange member 30 are two support fences 28, 29. Recessed steps 35, 37 are formed on along the outer edges of the outside flange member 27 which allow the panels 31, 50, respectively, to nest inside the outside flange member 27. The two support fences 28, 29 are shorter than the adjacent section of the adjacent outside flange member 27 so that when the two panels 31, 50 are placed over the interior frame 14, the two support fences 28, 29 support their outer edges of the two panels 31, 50, respectively.

As stated above, the support flange member 30 extends inward from the outside flange member 27. As shown in, FIGS. 6-8, each support strut 23 is substantially parallel to the adjacent flange member 30. During assembly, first and second arrays of LED bulbs 70, 75, are attached to the opposite sides of the inside support flange member 30. When the panels 31 and 50 are placed over the inner interior frame 14, the two windows 38, 56 are aligned and registered over the outside flange member 27,the strut 23 and over the first and second arrays of LED bulbs 70 and 75, respectively.

Figure 9:
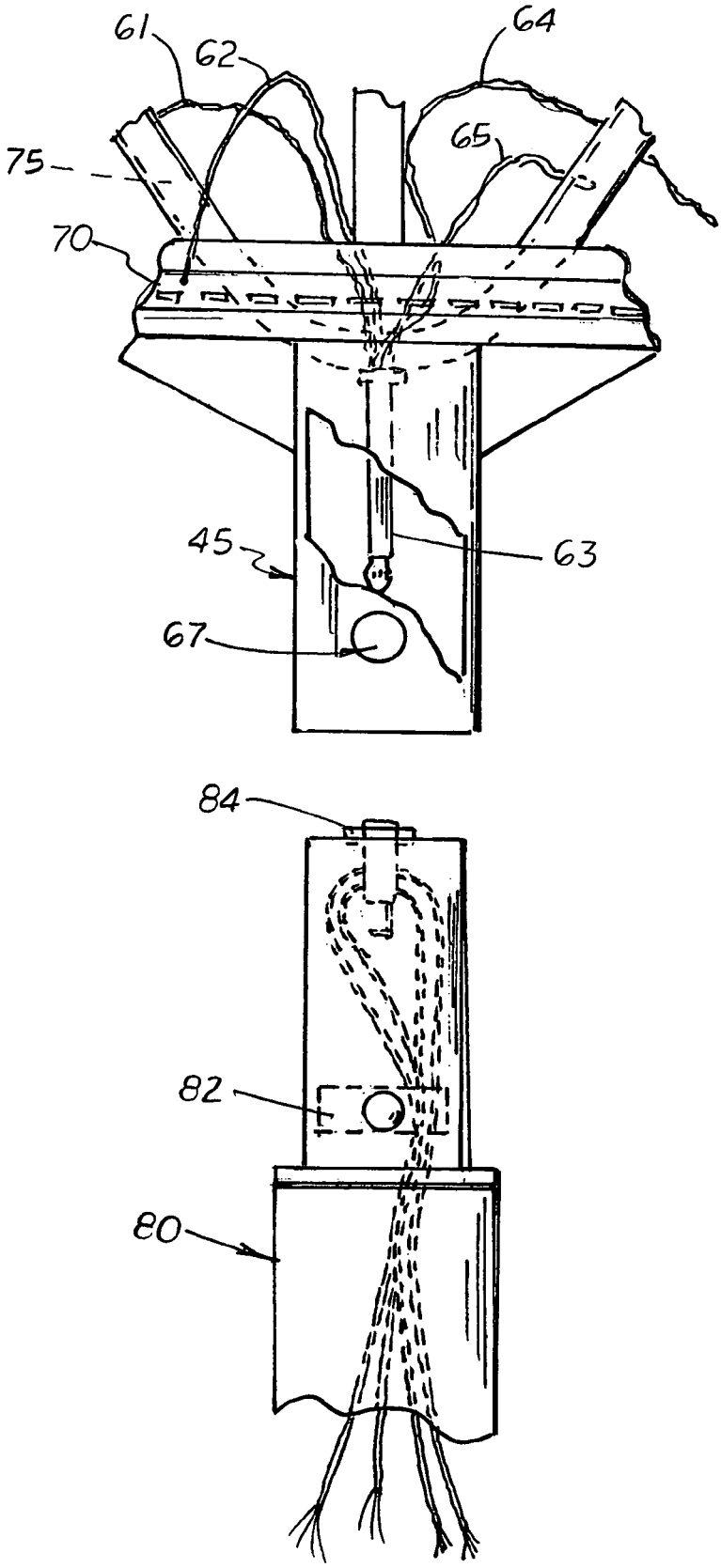
FIG. 9 is a partial, sectional view of the proximal end of the sign head being attached to the distal end of the pole.

As shown in FIG. 9, attached or integrally formed on the interior frame 14 is a downward extending hollow neck 45. Extending downward and longitudinally inside the neck 45 is a male cylindrical plug 63. Attached to the male plug 63 are two pairs of wires 61, 62 and 64, 65 that connect to the two arrays of LED bulbs 70, 75, respectively. Formed on the lower end of the neck 45 is a receiver hole 67 designed to receive a push button connector 82 attached to the distal end of the pole 80.

In the preferred embodiment, the sign head 12 is selectively attached to the distal end of the lightweight pole 80. Attached to the distal end of the pole 80 is a female connector 84 designed to receive the male plug 63 when the distal end of the pole 80 is inserted into the neck 45.

The first and second panels 31, 50 are made of constructed poly-carbonate covered with screen printed, DOT approved reflective sheeting 105. Each sign panel 31, 50 snap fits tightly into the outer support structure 16 to create a weather-proof structure that protects the first and second arrays of LED bulbs 70, 75.

Figure 10:
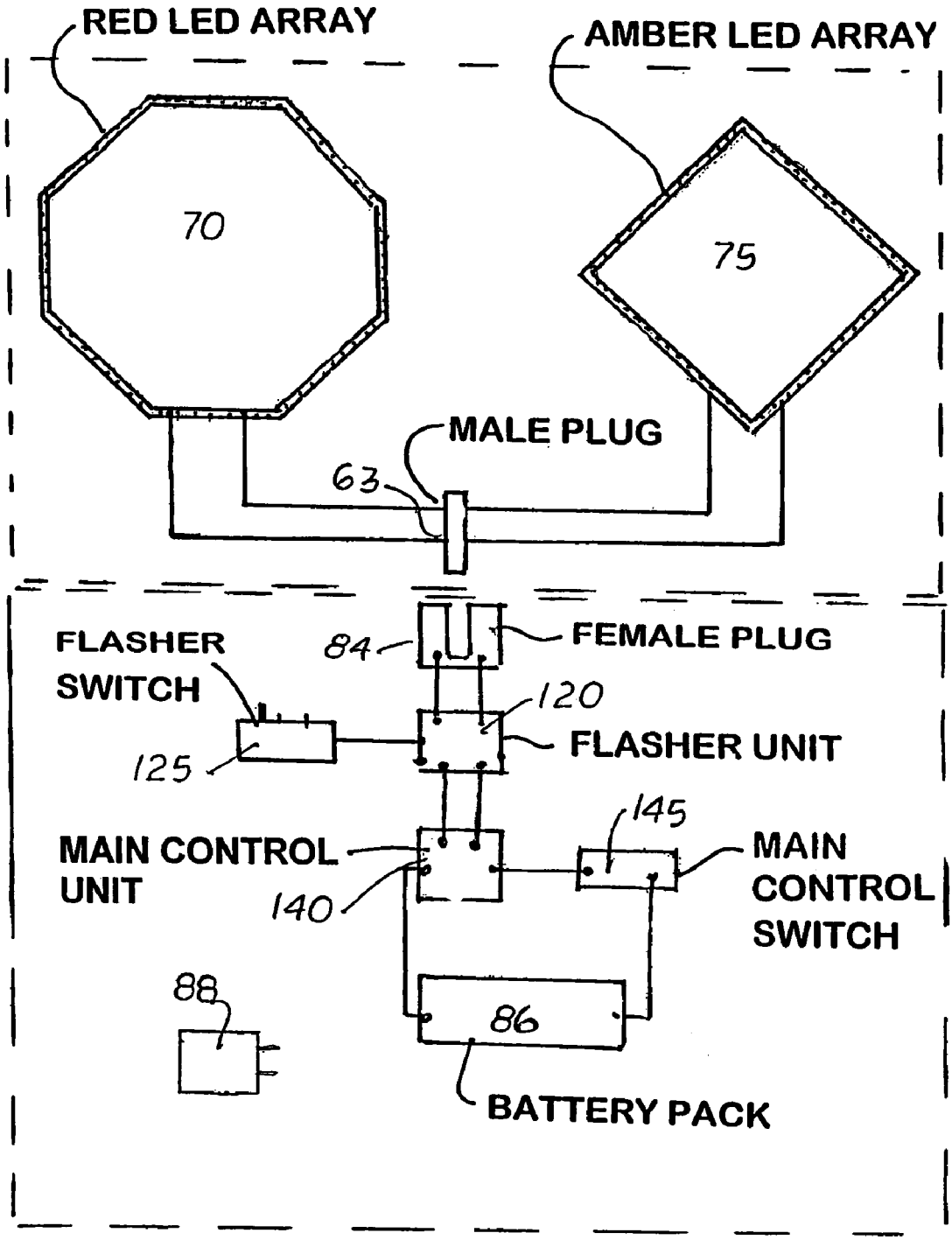
FIG. 10 is an illustration showing the location of the electrical components using in the traffic control sign.

FIG. 10 is an illustration showing the electrical components used in the traffic control sign 10 and their relative locations. In the preferred embodiment, all of the bulbs in the first array of LED bulbs 70 are RED and all of the bulbs of the second array of LED bulbs 75 are AMBER. The two arrays 70 and 75 are electrically connected to the male plug 63. In the preferred embodiment, the interior frame 14 in the sign head 12 and the pole 80 are both made of made of PVC approximately 1 -⅜ to 1 -⅛ inch diameters, respectively, so that the distal end of the pole 80 slides easily into the neck 45.

Located in the pole 80 is a main control unit (MCU) 140. Connected to the MCU 140 is a main control switch 145. In the preferred embodiment, the main control switch 145 is a multiple pole switch which allows the user to selectively illuminate each array 70, 75 independently or turn them both ON. For example, the MCU 140 and the main control switch 145 may be configured so that only the first array of LED bulbs 70 is illuminated when the main switch 145 is placed in a first position. When placed in a second position only, the second array of LED bulbs 75 is illuminated. When placed in the third position, both arrays 70, 75 are illuminated. The MCU 140 includes a processor used to control activation and deactivation of the two arrays of LED's 70, 75.

Connected to the MCU 140 and mounted on the side of the pole 80 is an optional flasher switch 125. In the preferred embodiment, the flasher switch 125 is a momentary, four pole switch that allows the operator to turn OFF the flasher unit 120, first sign panel 31 ON only, second sign panel 50 ON only, and both sign panels ON. During use, the operator may alert incoming traffic with greater urgency he or she can push and hold the flasher switch 125 causing the arrays of LED bulbs 70, 75 to flash until the operator releases the flasher switch 125.

As shown in FIG. 3, mounted inside the lower end of the pole 80 is a battery pack 86 that connects to the MCU 140, the main control switch 145 and the flasher switch 125. In the preferred embodiment, the battery pack 86 may be replaceable and rechargeable and may include a built in recharger unit 88 designed to plug into a standard 120 Volt AC outlet.

In the preferred embodiment, the sign head 12 is approximately 19 inches wide. The pole 80 is 4 to 8 feet in height. The transparent window 38, 56 formed on each panel, 31, 50, respectively, is made of clear polycarbonate or similar material that allows bright light from a first and second arrays of LED bulbs 70, 75, respectively, to shine through during operation. In the preferred embodiment, the remaining sections of each sign panel 31, 51 are also made of polycarbonate or similar material with retro-reflective material applied or attached to the outer surfaces of the two sign panels 31, 50 so that lights from the approaching motor vehicles may be used to illuminate the sign 10.

In compliance with the statute, the invention described herein has been described in language more or less specific as to structural features. It should be understood however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An adaptable illuminated or non-illuminated portable traffic control sign to be used , comprising:

a. a pole with a distal end and a proximal end;

b. an interior frame attached to said proximal end of said pole, said interior frame includes an octagonal-shaped outer support structure and an a diamond-shaped, -inner support structure, said outer support structure includes an inside support flange member and said inner support structure being located substantially within said outer support structure;

c. a first array of LED bulbs attached to one side of said outer support structure;

d. a sign panel made of retro-reflective material and disposed on one side of said interior frame and over said first array of LED bulbs, said first traffic display panel including the word STOP surrounded by a transparent window located around the perimeter edge of said sign panel that is aligned and registered over said first array of LED bulbs thereby protecting said first array LED bulbs and enabling light from said first array of LED bulbs to be seen when position in front of said sign panel;

e. a second array of LED bulbs attached to said inner support structure on said interior frame said second array of LED bulbs being located on a side of said inner support structure opposite said first array of LED bulbs;

f. a second sign panel made of retro-reflective material and disposed over said interior frame on the side opposite said first sign panel, said second sign panel including the word SLOW by a transparent window that is aligned and registered over said second array of LED bulbs thereby protecting said second array of LED bulbs and enabling light from said second array of LED bulbs to be seen when position in front of said second sign panel;

g. a main control unit connected to said first array of LED bulbs and said second array of LED bulbs;

h. a battery pack located inside said pole is attached to said main control unit; and, i. an LED array control switch is connected to said main control unit and used to selectively control the activation and deactivation of said first array of LED bulbs and said second array of LED bulbs.

2. The portable traffic control sign as recited in claim 1, wherein said interior frame is T shaped in cross-section and includes an outside flange member and a perpendicularly aligned inside support flange member, said first array of LED bulbs being attached to one side of said inside support flange member.

3. The portable traffic control sign as recited in claim 1, further including a flasher unit and a flasher switch connected to said first and second arrays of LED bulbs.

4. The portable traffic control sign as recited in claim 1, further including a flasher unit and a flasher switch connected to said first and second arrays of LED bulbs.

5. The portable traffic control sign as recited in claim 1, further including a battery charger used to recharge said battery.

6. The portable traffic control sign, as recited in claim 1, wherein said first array of LED bulbs is RED.

7. The portable traffic control sign, as recited in claim 1, wherein said second array of LED bulbs is AMBER.

8. A portable traffic control sign, comprising:

a. a pole with a distal end and a proximal end;

b. an octagonal-shaped outer support structure attached to said proximal end of an pole, said interior frame being T-shaped in cross-section and includes a continuous wide outer flange member and an inward extending flange member;

c. a diamond-shaped inner support structure located within said outer support structure;

d. a first array of LED bulbs attached to said inward extending flange member on said outer support structure;

e. a first sign panel made of retro-reflective material and disposed on one side of said interior frame, said first sign panel including a first traffic control message surrounded by at least one transparent window that is aligned and registered over said first array of LED bulbs;

f. a second array of LED bulbs are attached to said inner support structure;

g. a second sign panel made of retro-reflective material and disposed over said outer support structure and said inner support structure interior frame on the side opposite said first sign panel, said second sign panel includes a second traffic control message surrounded by at least one transparent window that is aligned and registered over said second array of LED bulbs;

h. a battery pack located inside said pole is attached to said first and second array of LED bulbs; and, i. a main switch disposed between said battery pack and said first and second arrays of LED bulbs.

9. The portable traffic control sign as recited in claim 1, wherein said pole is removably attached to said interior frame.

10. The portable traffic control sign as recited in claim 9 where said traffic control message on said first sign panel is the word STOP.

11. The portable traffic control sign as recited in claim 9 where said traffic control message on said second sign panel is the word SLOW.

* * * * *